US007670266B2

(12) United States Patent
Cornejo et al.

(10) Patent No.: US 7,670,266 B2
(45) Date of Patent: Mar. 2, 2010

(54) ARTICULATING LINKAGE EXERCISE MACHINE

(75) Inventors: Victor Torres Cornejo, Tustin, CA (US); Mark William Chiles, Yorba Linda, CA (US); James Dey, Corona, CA (US); Felipe J. Marin, Santa Ana, CA (US); Kevin Patrick Corbalis, Tustin, CA (US)

(73) Assignee: Unisen, Inc., Irvine, CA (US)

( * ) Notice: Subject to any disclaimer, the term of this patent is extended or adjusted under 35 U.S.C. 154(b) by 965 days.

(21) Appl. No.: 11/192,977

(22) Filed: Jul. 29, 2005

(65) Prior Publication Data

US 2006/0079381 A1 Apr. 13, 2006

Related U.S. Application Data

(60) Provisional application No. 60/592,615, filed on Jul. 30, 2004.

(51) Int. Cl.
*A63B 22/04* (2006.01)
*A63B 69/16* (2006.01)

(52) U.S. Cl. ..... 482/52; 482/57; 482/62

(58) Field of Classification Search ..... 482/51–53, 482/57–62
See application file for complete search history.

(56) References Cited

U.S. PATENT DOCUMENTS 5,374,227 A * 12/1994 Webb ..... 482/52
5,637,058 A 6/1997 Rodgers, Jr.
5,690,589 A 11/1997 Rodgers, Jr.
5,738,614 A 4/1998 Rodgers, Jr.
5,766,113 A 6/1998 Rodgers, Jr.
5,769,760 A * 6/1998 Lin et al. ..... 482/52
5,788,610 A * 8/1998 Eschenbach ..... 482/52
5,792,026 A 8/1998 Maresh et al.
5,848,954 A 12/1998 Stearns et al.
5,899,833 A 5/1999 Ryan et al.
5,913,751 A 6/1999 Eschenbach
5,924,962 A 7/1999 Rodgers, Jr.
5,997,445 A 12/1999 Maresh et al.
6,045,487 A 4/2000 Miller
6,063,008 A 5/2000 McBride et al.
6,196,948 B1 3/2001 Stearns et al.
6,206,804 B1 3/2001 Maresh
6,277,055 B1 8/2001 Birrell et al.
6,500,096 B1 12/2002 Farney
6,544,146 B1 * 4/2003 Stearns et al. ..... 482/52
6,645,125 B1 11/2003 Stearns et al.
6,672,994 B1 1/2004 Stearns et al.
6,837,829 B2 1/2005 Eschenbach
7,097,591 B2 * 8/2006 Moon ..... 482/52
7,223,209 B2 5/2007 Lee
7,238,146 B1 7/2007 Chen (Continued)

OTHER PUBLICATIONS

International Search Report, 3 pages.

*Primary Examiner*—Steve R Crow
(74) *Attorney, Agent, or Firm*—Knobbe, Martens, Olson & Bear, LLP

(57) ABSTRACT

An elliptical machine has a frame and an operating linkage between the frame and foot supports. Each side of the operating linkage comprises five links that are connected with five pin joints. A foot support is connected to each side of the operating linkage with each of the five pin joints being positioned forward of the foot support.

11 Claims, 13 Drawing Sheets

U.S. PATENT DOCUMENTS

| | | | |
|---|---|---|---|
| 2001/0056010 | A1 | 12/2001 | Stearns et al. |
| 2004/0053748 | A1 | 3/2004 | Lo et al. |
| 2004/0097339 | A1 | 5/2004 | Moon |
| 2004/0235621 | A1 | 11/2004 | Eschenbach |
| 2004/0248704 | A1 | 12/2004 | Rodgers, Jr. |
| 2004/0248705 | A1 | 12/2004 | Rodgers, Jr. |
| 2004/0248706 | A1 | 12/2004 | Rodgers, Jr. |
| 2004/0248707 | A1 | 12/2004 | Rodgers, Jr. |
| 2004/0248708 | A1 | 12/2004 | Rodgers, Jr. |
| 2004/0248709 | A1 | 12/2004 | Rodgers, Jr. |
| 2004/0248710 | A1 | 12/2004 | Rodgers, Jr. |
| 2004/0248711 | A1 | 12/2004 | Rodgers, Jr. |
| 2005/0003932 | A1 | 1/2005 | Chen et al. |
| 2006/0166791 | A1 | 7/2006 | Liao et al. |

* cited by examiner

ARTICULATING LINKAGE EXERCISE MACHINE

RELATED APPLICATIONS

This application claims the priority benefit of U.S. Provisional Patent Application No. 60/592,615, filed Jul. 30, 2004, which is hereby incorporated by reference in its entirety.

BACKGROUND OF THE INVENTION

1. Field of the Invention

The present invention generally relates to elliptical exercise machines. More particularly, the present invention relates to elliptical exercise machines featuring articulating linkages that generate elliptical foot traces for a user.

2. Description of the Related Art

Most previous elliptical exercise machines have employed guides or tracks that forced one end of a foot support to move in a substantially linear manner while the other end of the foot support rotated about a crank axis. A user's foot would be positioned at an intermediate location along the foot support. As a result of this construction, the movement of the user's foot would generate a generally elliptical trace.

While the elliptical motion generated by these machines has been desired by many fitness enthusiasts, the elongated foot supports have dictated relatively large machine foot prints. In addition, rear supports or linkages must be provided for the rear ends of the foot supports, which rear supports or linkages have been positioned substantially rearward of the elliptical trace generated by the user's foot. Thus, each elliptical machine required a large amount of floor space within a commercial gym setting or within a home gym. Floor space often comes at a premium and, thus, an elliptical machine is desired that can reduce the amount of floor space required for each machine.

SUMMARY OF THE INVENTION

Accordingly, an elliptical exercise machine has been developed that can reduce the overall footprint of the machine. In accordance with one embodiment of the machine, a linkage assembly that constrains a pair of foot pedals for elliptical movement is positioned entirely ahead of a rearmost portion of the foot pedals. In other words, the foot pedals or foot supports are cantilevered to a location rearward of the linkage assembly.

One aspect of the present invention involves an elliptical exercise machine comprising a generally stationary frame assembly. An operating linkage is supported by the frame assembly. The frame assembly comprises at least one rearmost upright. The operating linkage is connected to a first foot support and a second foot support. Each of the first and second foot supports is adapted to receive a user's foot. The operating linkage comprises a first side and a second side. The first side comprises four moving links connected by three pin joints and the second side comprises four moving links connected by three pin joints. Each of the three pin joints on the first side is positioned forward of the first foot support and each of the three pin joints on the second side is positioned forward of the second foot support. Each of the first and second foot supports moves through a generally elliptical foot trace during operation of the machine and the foot trace is located rearward of the rearmost upright.

Another aspect of the present invention involves an elliptical exercise machine comprising a generally stationary frame assembly. An operating linkage is supported by the frame assembly. The operating linkage comprises a left subassembly and a right subassembly. The left subassembly comprises a first geared five bar mechanism and the right subassembly comprises a second geared five bar mechanism.

A further aspect of the present invention involves an elliptical exercise machine comprising a generally stationary frame assembly. A first crank is rotationally coupled to the frame assembly. The first crank has a second end rotatable about a first rotational axis that extends through a first end of the first crank. The second end of the first crank is rotationally connected to a first end of a first coupler link. A second crank is rotationally coupled to the frame assembly. The second crank has a second end rotatable about a second rotational axis that extends through a first end of the second crank. The second end of the second crank is rotationally connected to a first end of a second coupler link. A second end of the second coupler link is connected to the first coupler link. A foot support is supported by the first coupler link and the first and second cranks are synchronized together.

BRIEF DESCRIPTION OF THE DRAWINGS

These features, aspects and advantages will be described in detail with reference to the accompanying drawings. The drawings comprise fifteen figures.

DETAILED DESCRIPTION OF THE PREFERRED EMBODIMENT

Figure 1:
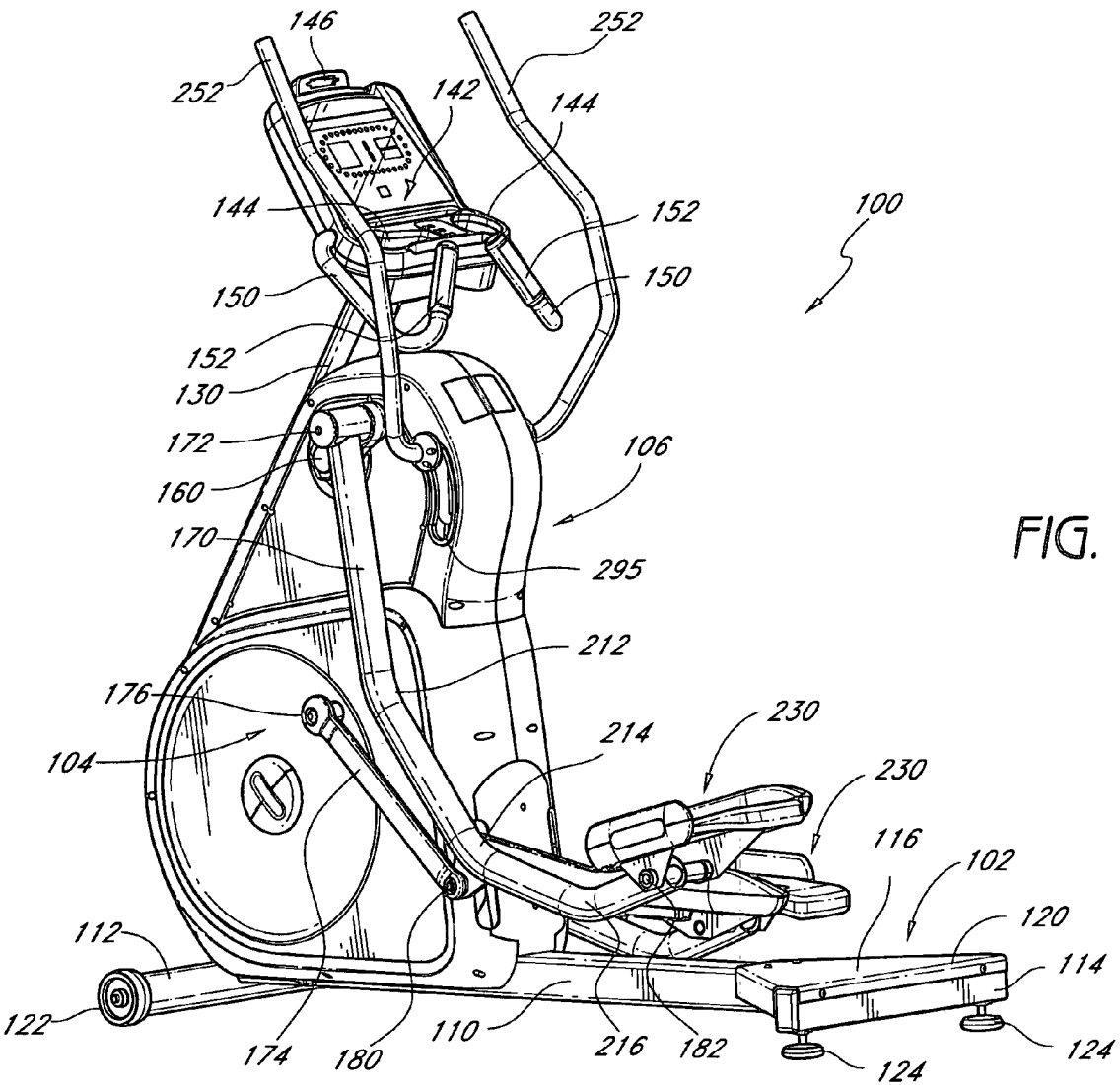
FIG. 1 is a perspective view of an exercise machine that is arranged and configured in accordance with certain features, aspects and advantages of the present invention.
Figure 2:
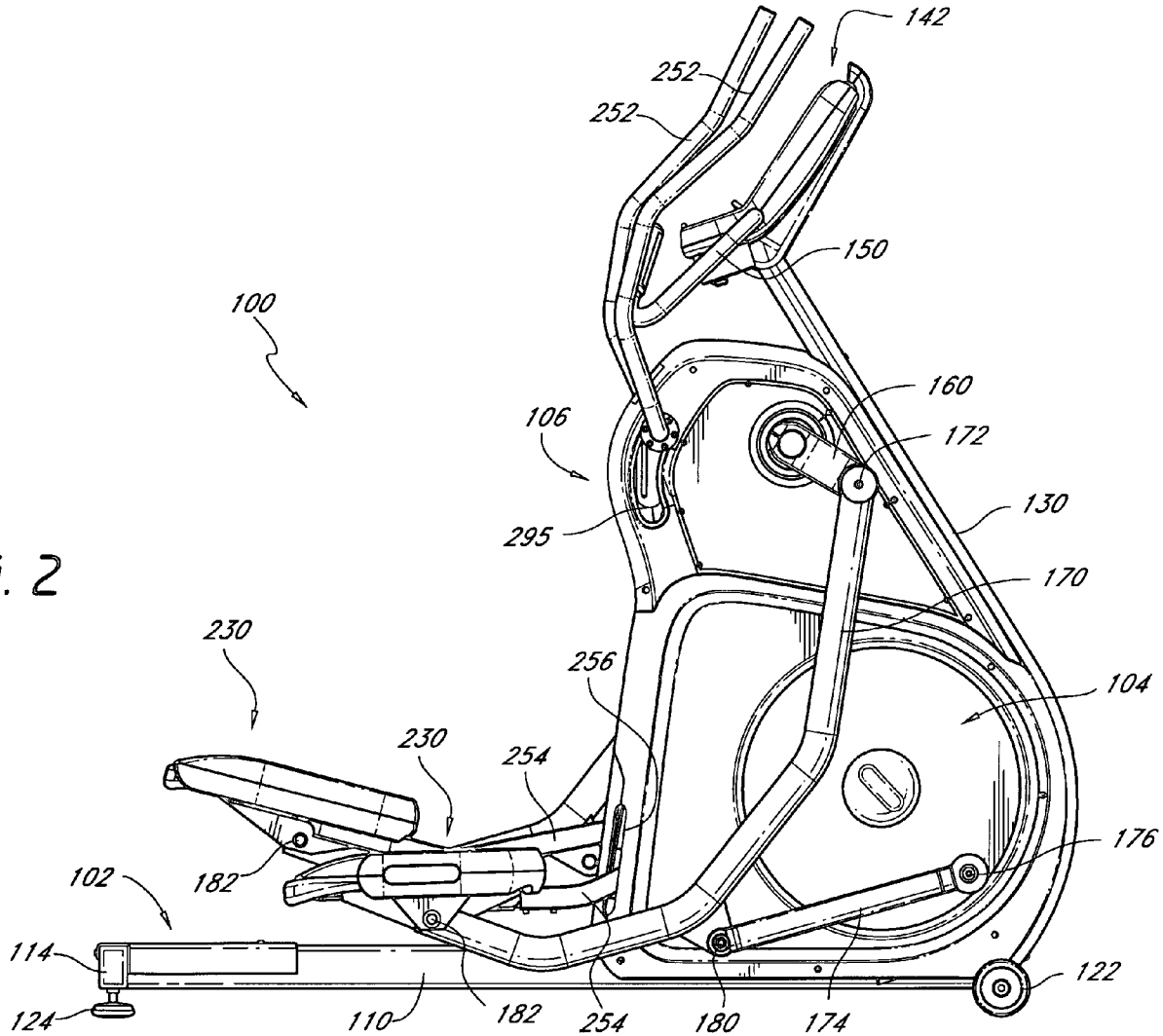
FIG. 2 is a right side elevation view of the exercise machine of FIG. 1.
Figure 3:
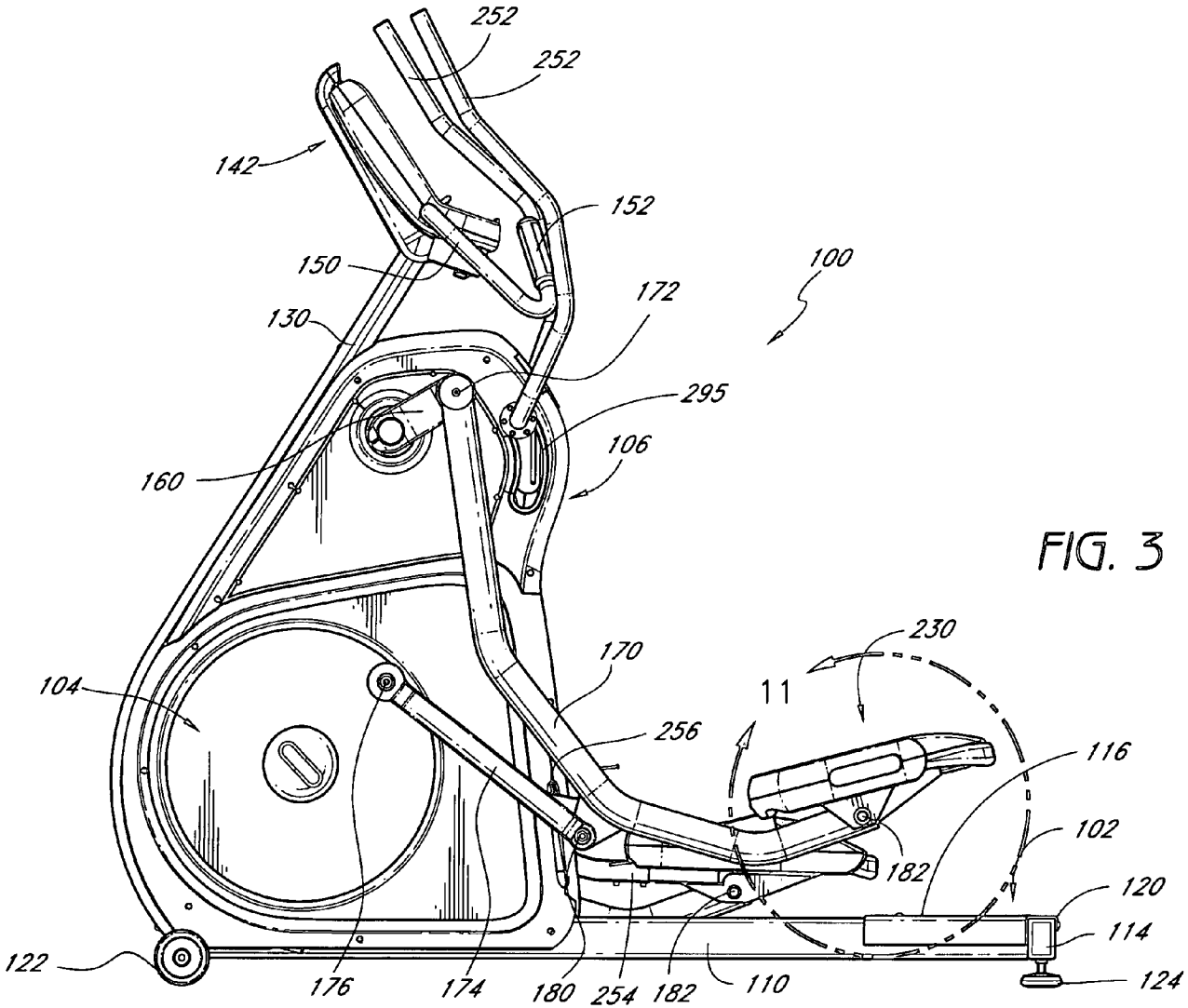
FIG. 3 is a left side elevation view of the exercise machine of FIG. 1.
Figure 5:
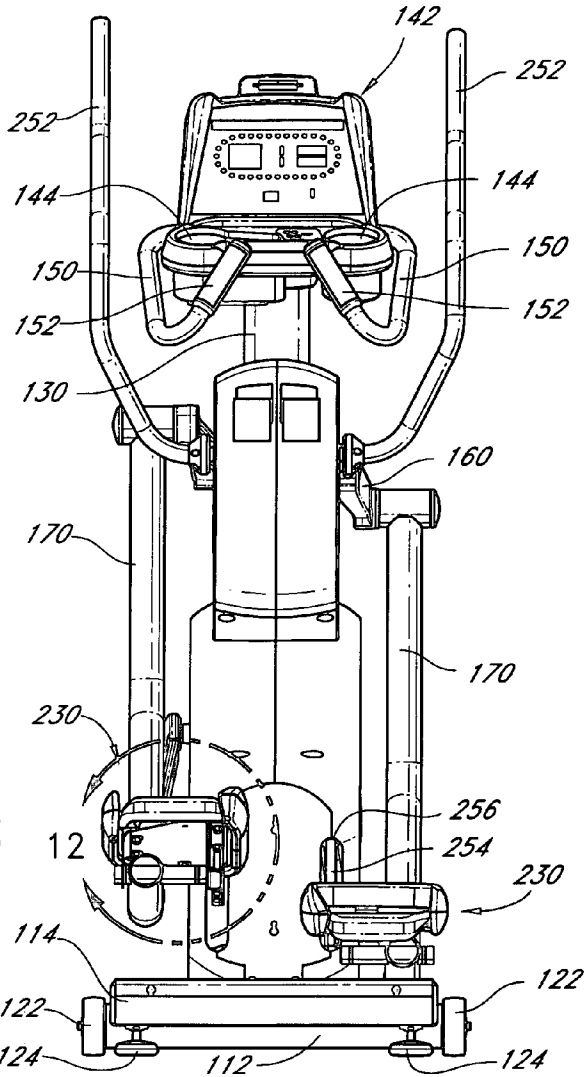
FIG. 5 is a rear side elevation view of the exercise machine of FIG. 1.
Figure 4:
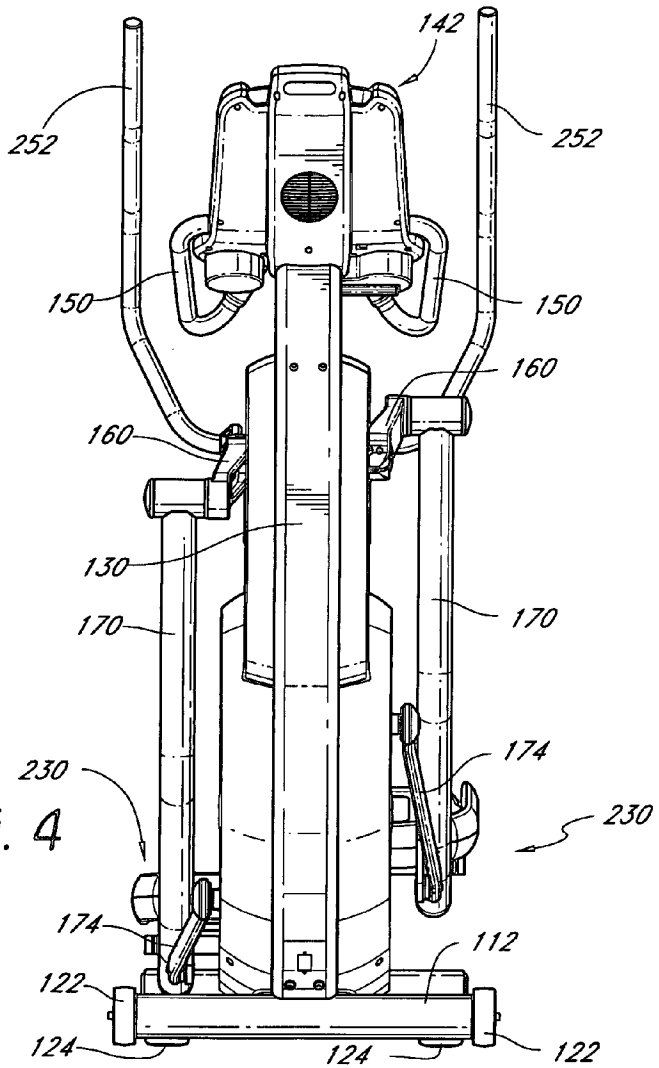
FIG. 4 is a front side elevation view of the exercise machine of FIG. 1.

With reference initially to FIGS. 1-7, the illustrated exercise machine 100 is adapted for stationary positioning on a floor during exercise. As such, the machine 100 comprises a frame assembly 102 that supports an operating linkage 104 (see FIG. 8 for a view of a majority of the frame assembly, FIG. 9 for a skeletal illustration of the operating linkage 104 and FIG. 10 for a clearer view of the integration of the frame 102 and the linkage 104). A housing 106 encloses a substantial portion of both the frame 102 and the linkage 104.

With reference now to FIG. 1, the frame 102 preferably comprises a longitudinally extending center beam 110. At the forward end of the center beam 110, a laterally extending front cross beam 112 is secured to the center beam 110. At the rearward end of the center beam 110, a rear cross beam 114 is secured to the center beam 110. Together, the center beam 110, the front cross beam 112 and the rear cross beam 114 define a support base. Other support base arrangements also can be used keeping in mind the desire for stability during use of the exercise machine 100.

Figure 6:
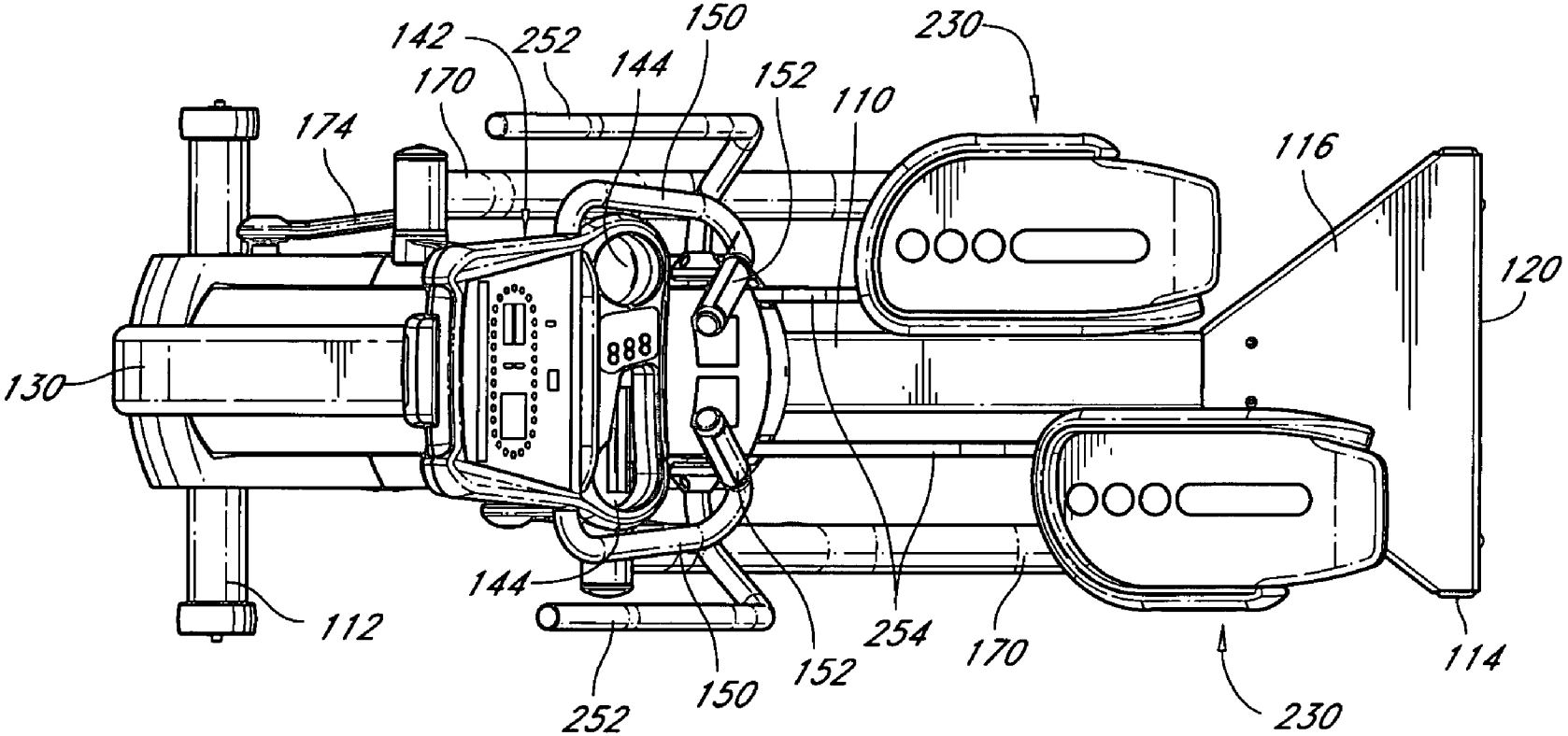
FIG. 6 is a top plan view of the exercise machine of FIG. 1.
Figure 7:
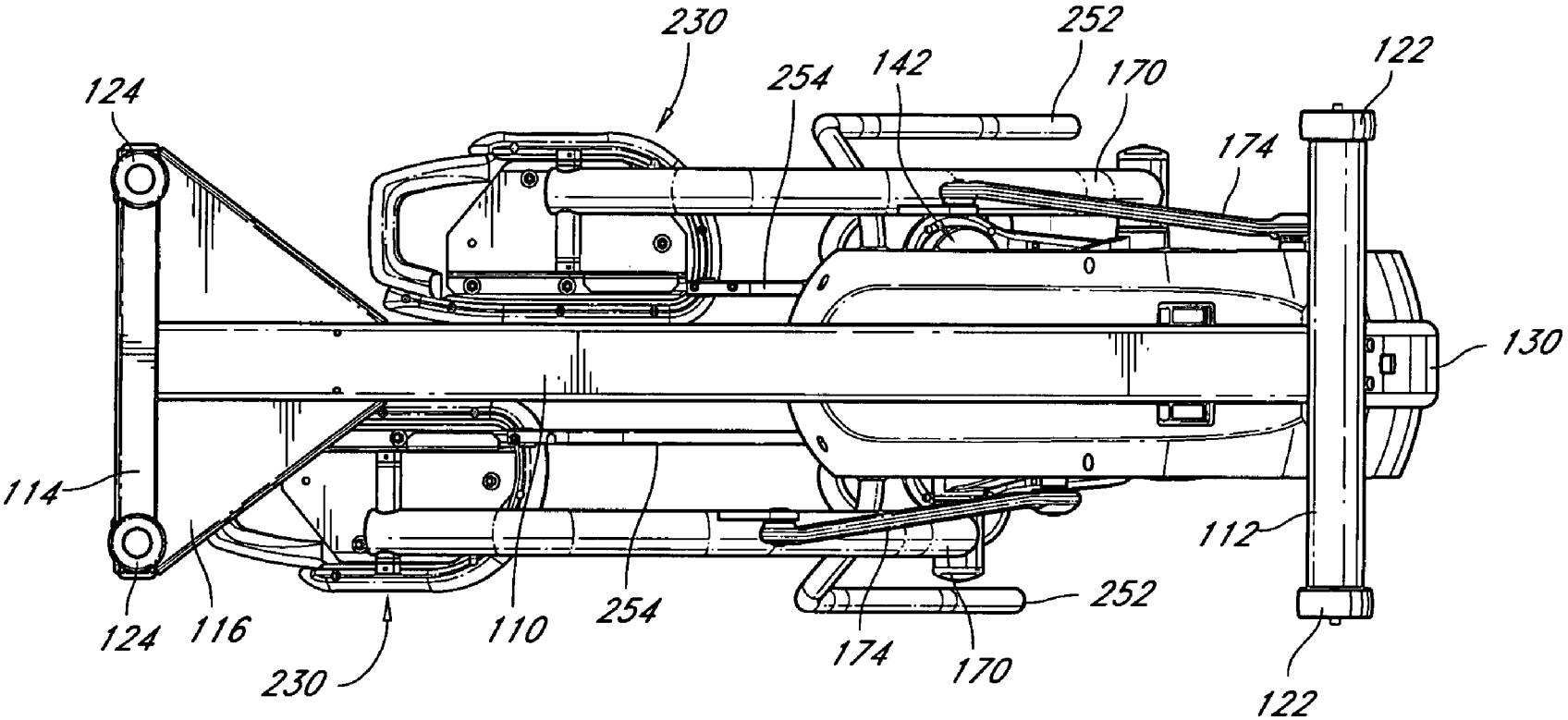
FIG. 7 is a bottom plan view of the exercise machine of FIG. 1.

With reference to FIG. 6, a rear platform 116 is positioned over the center beam 110 and a portion of the rear cross beam 114. The rear platform 116 can be omitted in some applications; however, in the illustrated embodiment, the rear platform 116 provides a convenient structure for mounting the exercise machine 100. The illustrated platform has a generally triangular shape; other configurations also can be used. Preferably, a rearmost end 120 of the platform 116 defines a rearmost extent of the exercise machine 100 during exercise. In other words, the operating linkage 104 preferably is positioned entirely forward of the rearmost end 120 of the platform 116 during all phases of exercise motion.

With reference again to FIG. 1, the illustrated machine 100 comprises a pair of forward rollers 122 (see also FIG. 6) and a pair of rear adjustable feet 124. The illustrated rollers 122 are mounted to the sides of the front cross beam 122 and the illustrated feet 124 are positioned under the rear cross beam 124. The placement of the rollers 122 and the feet 124 can be varied in other configurations. The adjustable feet 124 can be moved generally vertically in and out of the rear cross beam 124 to level the rear cross beam 124. In some configurations, the entire exercise machine 100 can be supported by adjustable feet. Such configurations, however, decrease the ability to easily reposition the exercise machine 100 within an exercise space for cleaning of the floor space or the like.

Figure 8:
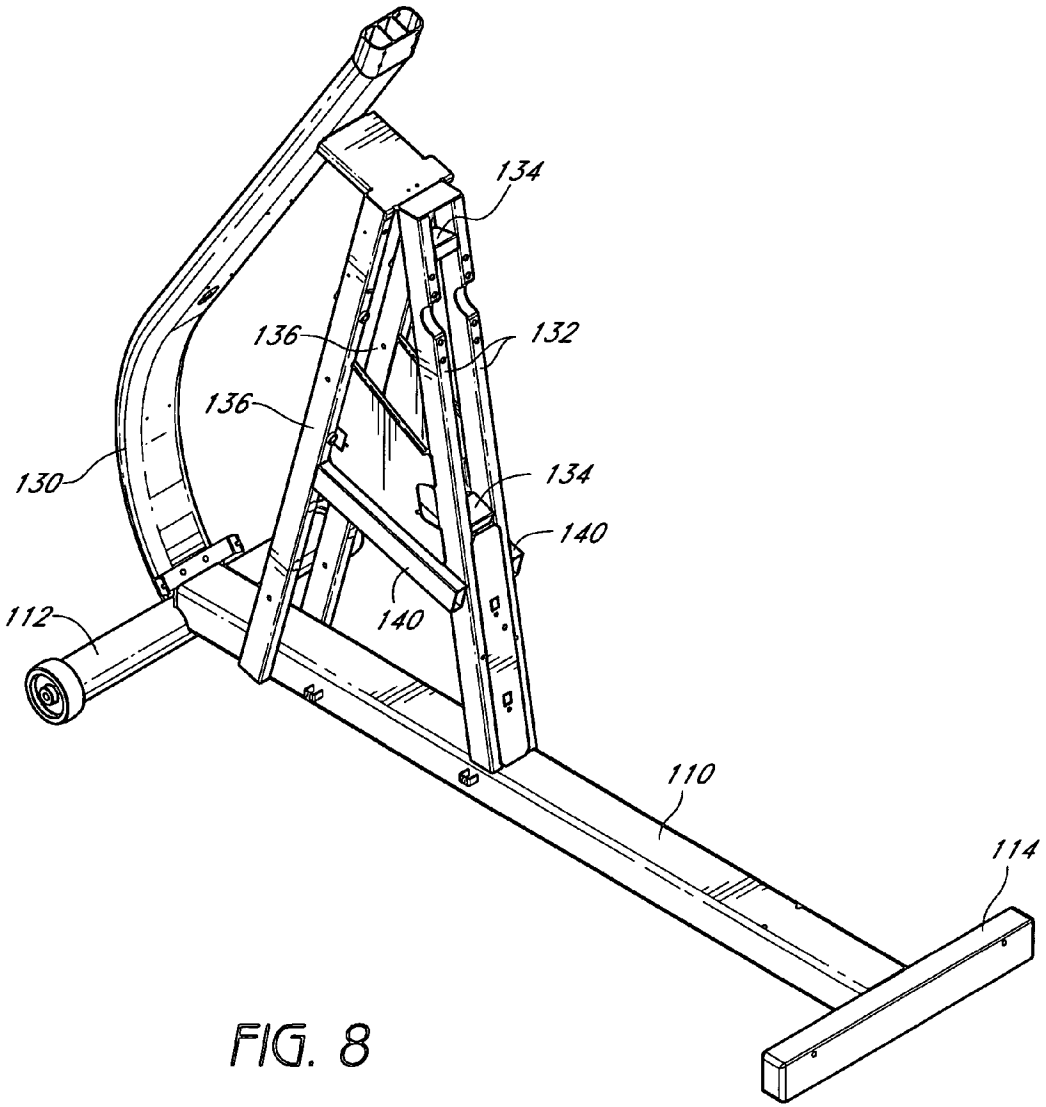
FIG. 8 is a top left perspective view of a portion of a frame assembly of the exercise machine of FIG. 1.

With reference now to FIG. 8, the frame assembly 102 preferably comprises one or more upright members. In the illustrated arrangement, a forward display standard 130 curves upward from the forward end of the center beam 110. The forward display standard 130 preferably is generally rectangular and more preferably is generally hollow such that the display standard 130 can form a conduit through which wires and the like can be routed. The illustrated display standard 130 is curved mainly for esthetic reasons.

Two rearward posts 132 extend upward along a central portion of the center beam 110. The posts 132 preferably slope slightly forward and are joined by one or more cross braces 134. Two intermediate posts 136 slope slightly rearward. Together, the intermediate posts 136 and the rearward posts 132 define a generally A-shaped upright frame that supports the illustrated operating linkage 104. One or more interconnecting braces 140 can be used to connect the intermediate posts 136 and the rearward ports 132. Other arrangements also can be used.

With reference again to FIG. 1, in the illustrated configuration, a display console 142 is connected to an upper end of the display standard 130. The display console 142 can have any suitable configuration. For instance, the display console 142 can be configured in a manner such as that set forth in copending U.S. patent application Ser. No. 10/299,625, filed on Nov. 19, 2002, which is incorporated by reference in its entirety. In the illustrated arrangement, the display console 142 allows information to be conveyed to and from a user in an interactive manner through a display screen, pushbuttons or the like. Moreover, the illustrated display console 142 comprises one or more receptacles 144 for holding water bottles, keys and other items that may be carried by users. The receptacles 144 also can be designed to incorporate features from copending U.S. Pat. No. 10/698,236, filed on Oct. 31, 2003, which is incorporated by reference in its entirety. Further, the illustrated display console 142 comprises an air duct outlet 146 that conveys toward a user air from a suitable cooling system. The display console 142 also can be configured to implement features from copending U.S. Pat. No. 10/299,627, filed on Nov. 19, 2002, which is incorporated by reference in its entirety.

The illustrated display console 142 also comprises a pair of stationary handles 150 that can include pulse rate sensors 152. The handles 150 extend downward toward a user before bending upward and inward. The handles 150 provide a comfortable location for a user's hands while exercising and the pulse rate sensors 152 allow the exercise machine 100 to monitor the pulse rate of a user for use in any suitable control routine or for display to the user. While a certain display console 142 has been shown and described, any suitable display systems can be used or, in certain less advantageous configurations, the display console can be entirely omitted. Moreover, while the illustrated exercise machine 100 comprises a pair of stationary handles 150, the handles can be relocated or omitted in some constructions.

The frame 102 supports the operating linkage 104, a mechanism which will be described initially with reference to the skeletal illustration of FIG. 9. The mechanism can generate a desired elliptical motion at a trace point. In the illustrated configuration, the mechanism can be considered a geared five bar mechanism, which is defined herein as a five bar linkage attached to a gear train, and the trace point can be considered the location of the foot of the user. In the illustrated configuration, the gears are replaced by a drive belt configuration designed such that the gears rotate in the same direction at generally the same speed. Other configurations may use a gear train (e.g., a three gear train) or another suitable mechanical coupling to clock the mechanism in timed relationship. As used herein, a five bar linkage is meant to have its ordinary meaning and can include any linkage having four moving links connected by a fixed ground line (hence 5 links) and a geared five bar linkage is meant to have its ordinary meaning and can include a five bar linkage, such as described directly above, with two of the moving links connected by a gear train, pulley drive, belt drive, chain drive or the like. In some configurations, the two moving links can be connected by a single link (e.g., a locomotive style system), another linkage or the like.

Figure 9:
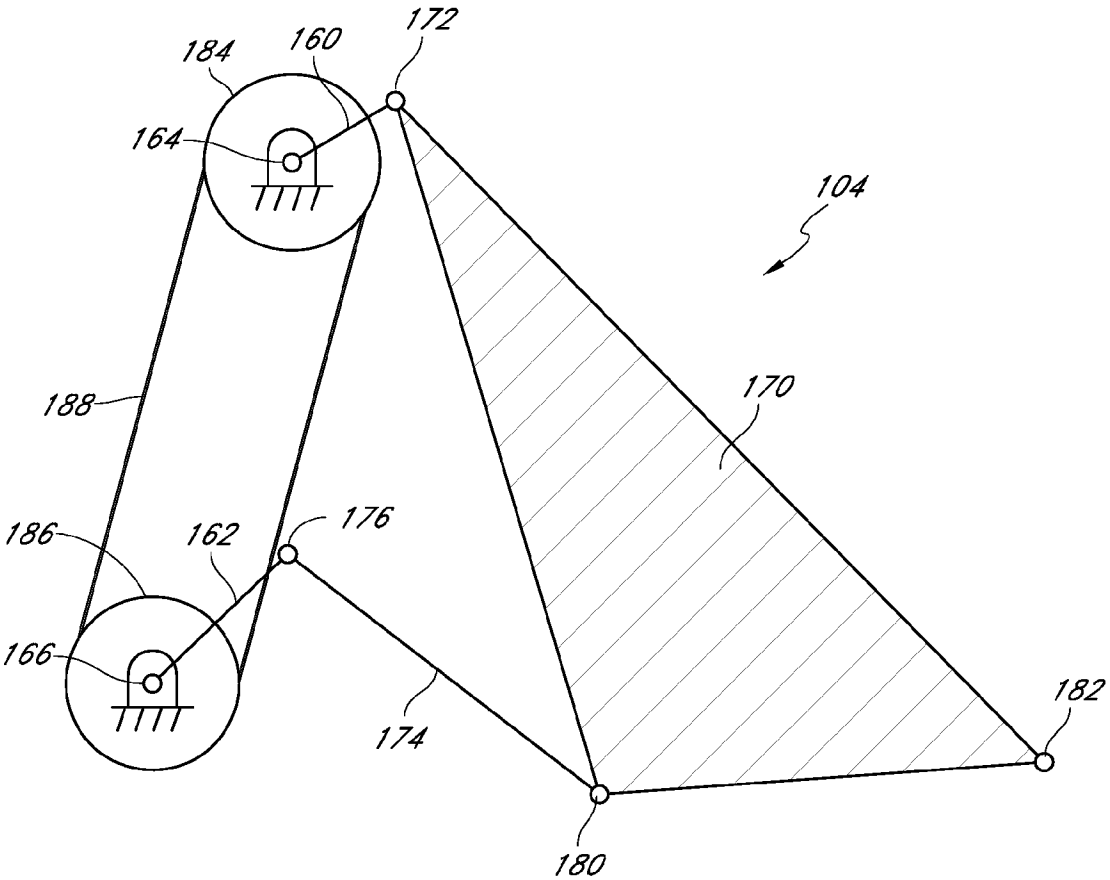
FIG. 9 is a skeleton view of a geared five bar mechanism used with the exercise machine of FIG. 1.

As illustrated in FIG. 9, the illustrated operating linkage 104 is actually a pair of operating linkages, one for the left foot and one for the right foot of a user. The two linkages 104 preferably are about 180 degrees out of phase. Other constructions can be used and, in some configurations, the operating linkages 104 can be separately operated and are not coupled together. For clarity and ease of description, only one of the two linkages 104 will be described in detail.

Figure 10:
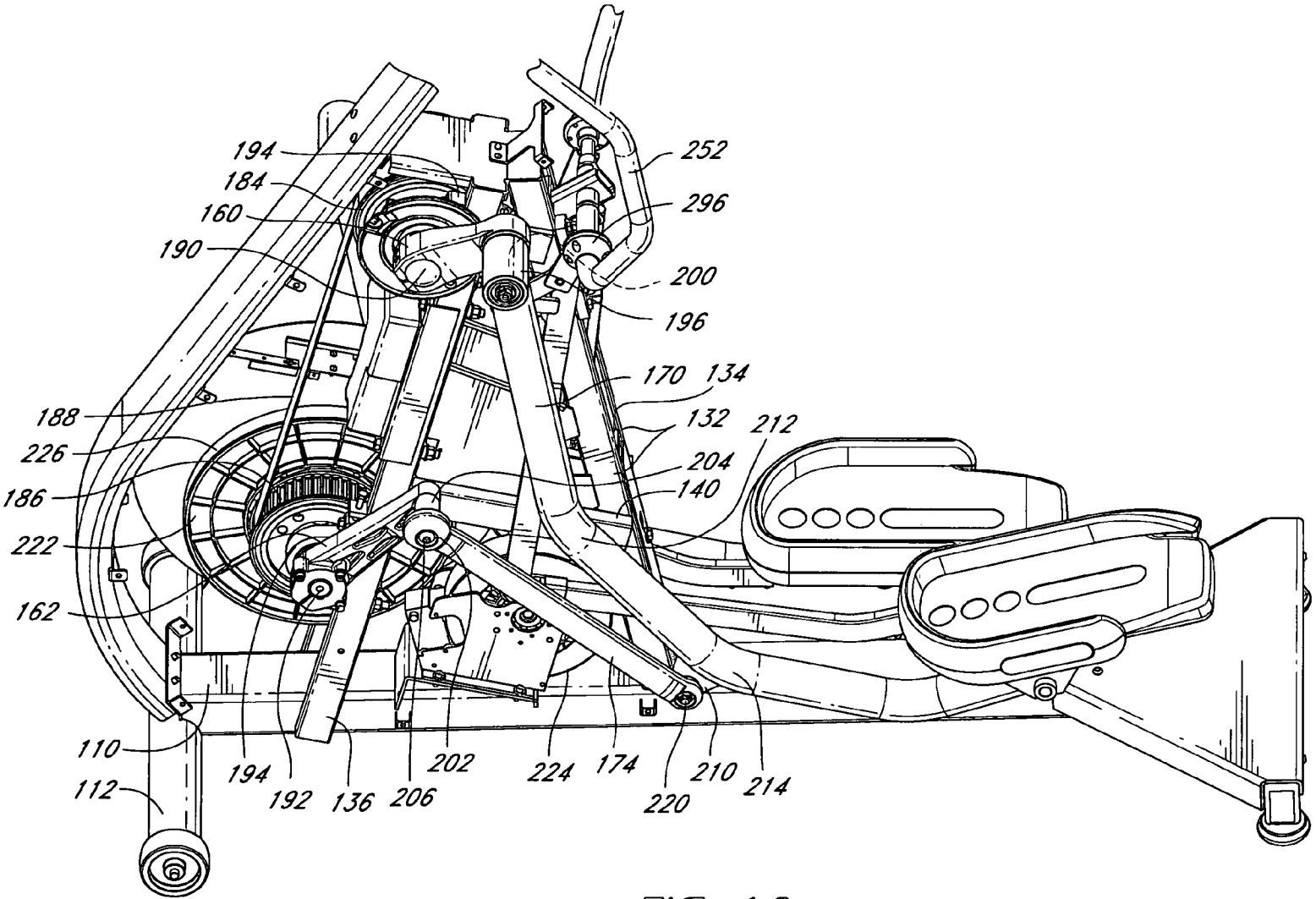
FIG. 10 is a top left perspective view of a lower forward portion of the exercise machine shown in FIG. 1 with some components, including a housing, a display, various covers and the like, removed for clarity.

Preferably, the operating linkage 104 comprises four moving links and a fixed "ground link," which results in five revolute, pivoted or pin joints. The "ground link" in the illustrated arrangement is formed by the frame assembly 102. The five bar mechanism preferably is largely, if not wholly, positioned within the region of the frame assembly 102. More preferably, a large portion of the operating linkage 104 is enclosed within the housing 106. Even more preferably, as illustrated in FIG. 10, all but one of the moving joints between the links in the illustrated arrangement are positioned forward of the rearward upright posts 132.

Figure 15:
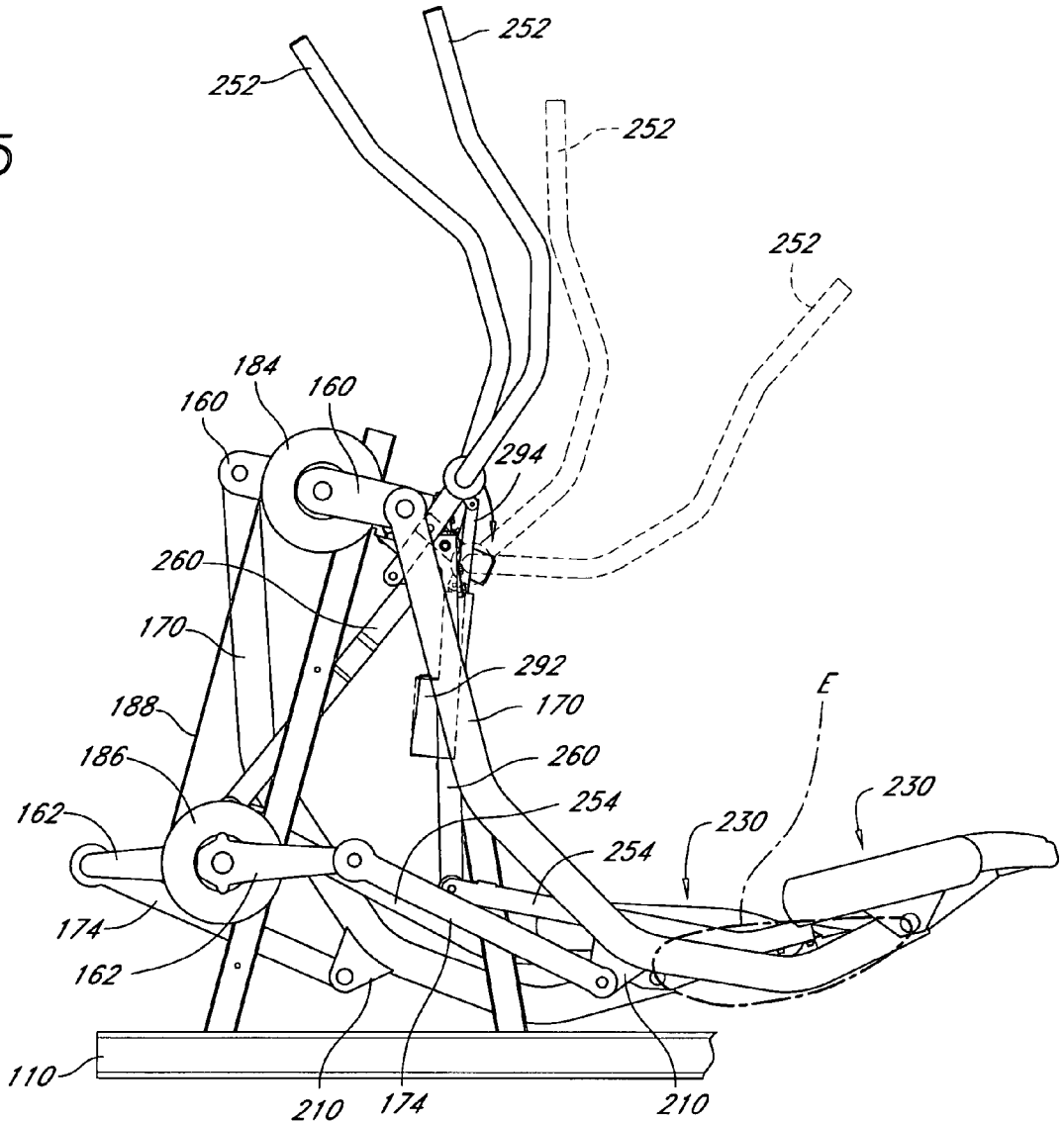
FIG. 15 is a simplified left side elevation view of the exercise machine of FIG. 1 showing a generally elliptical foot trace and shown a varying range of motion for the arm handles.

With reference to FIG. 9, the operating linkage 104 preferably comprises an upper crank 160 and a lower crank 162. The upper crank 160 rotates about an upper fixed rotational axis 164 to which a first end of the upper crank 160 is connected and the lower crank 162 rotates about a lower fixed rotational axis 166 to which a first end of the lower crank 162 is connected. A first end of a first coupler link 170 is joined to a second end of the upper crank 160 with a first pin joint 172. A first end of a second coupler link 174 is joined to a second end of the lower crank 162 with a second pin joint 176. A third pin joint 180 joins a second end of the first coupler link 174 and a second end of the second coupler link 174. The first coupler links 170 further comprises a trace point 182, which generally corresponds to a location of a support for a user's foot. During movement of the operating linkage 104, the trace point 182 follows a desired generally elliptical path. As such, when implemented on the exercise machine 100, the operating linkage 104 creates a substantially elliptical trace E for a user's foot, as shown in FIG. 15. The substantially elliptical trace that is generated can be varied by altering the lengths of the links 160, 162, 170, 174, the spacing and/or relative positioning of the ground points (e.g., 164, 166) or by adjusting the phase angle between the cranks 160, 162.

As discussed above, the operating linkage 104 preferably comprises a geared five bar mechanism. With reference to FIGS. 9 and 10, the operating linkage 104 also comprises an upper pulley 184, a lower pulley 186 and a flexible transmitting member 188 that wraps around both pulleys 184, 186. In a preferred arrangement, the pulleys 184, 186 have the same outer diameter such that both pulleys move at the same speed. Moreover, to simplify the construction, the upper pulley 184 preferably rotates about the upper fixed rotational axis 164 while the lower pulley 186 preferably rotates about the lower fixed rotational axis 166. The upper crank 160 can be secured to the upper pulley 184 for rotation with the upper pulley 184 and the lower crank 162 can be secured to the lower pulley 186 for rotation with the lower pulley 186. In some embodiments, the cranks can be omitted and the joints (e.g., 170, 176) can be formed as a structure part of the pulleys. As used herein, the term cranks is intended to be given its ordinary meaning and can include constructions in which a crank is integrated into a pulley. Regardless of whether the cranks are integrated into the pulleys or not, the cranks 160, 162 desirably rotate synchronously with each other. As will be described, the cranks 160, 162 can be positioned out of phase relative to each other but the cranks 160, 162 preferably are still synchronized to rotate at the same speed, even if out of phase.

Thus, as described above, the operating linkage 104 for each foot of a user preferably comprises four moving links (160, 162, 170 and 174) that are connected by three joints (172, 176, 180) with two of the four links connected by two additional joints (164, 166) to ground locations defined by the axes 164, 166, which are fixed relative to the frame assembly 102. The operating linkage 104 for each foot also comprises a clocking configuration, such as the belt 188 and the pulleys 184, 186, that connects two of the four links (e.g., 160, 162) for timed movement. The clocking configuration governs the movement of the pin joint 180 along a predetermined path. It is contemplated that a guiding structure also can be used to dictate the movement of the pin joint 180 along a predetermined path and, in such configurations, the belt drive may be omitted. For instance, a guide plate with a desired guide path, slot or groove formed in the guide plate can be used to guide the pin joint 180 along the predetermined path. As described herein, the clocking configuration and the guide plate configuration define means for controlling a path of movement of at least one pin joint of a five bar mechanism.

With reference now to FIG. 10, the exercise machine 100 is illustrated with certain components omitted such that the operating linkage 104 can be better shown. As illustrated, the upper fixed rotational axis 164 is defined by an upper axle 190 and the lower fixed rotational axis 166 is defined by a lower axle 192. In the illustrated arrangement, pillow block bearings 194 secure the axles 190, 192 to the frame assembly 102. In particular, the pillow block bearings 194 are mounted to the intermediate posts 136 in the illustrated configuration.

The upper crank 160 is mounted to the upper axle 190. The lower crank 162 is mounted to the lower axle 192. As illustrated, the cranks 160, 162 of the opposing sides of the exercise machine 100 preferably are mounted about 180 degrees out of phase from each other. In the illustrated arrangement, the upper pair of cranks 160 are positioned vertically higher than the lower pair of cranks 162 and the upper pair of cranks 160 are positioned rearward of the lower pair of cranks 162. Other crank placements and orientations also can be used keeping in mind the desire for a usable foot trace.

The first coupler link 170 has a generally tubular configuration. At the first end, the first coupler link 170 comprises a sleeve 196. A stub shaft 200 extends outward from the illustrated upper crank 160 and the sleeve 196 is positioned over the stub shaft 200. The sleeve 196 allows the stub shaft 200 to rotate within the sleeve such that the end of the first coupler link moves up, down, forward and rearward with the rotation of the stub shaft 200 about the upper axle 190, thereby defining the first pin joint 172. Any suitable connection between the first coupler link 170 and the upper crank 160 can be used keeping in mind the goal of creating up, down, forward and rearward movement of the first end of the first coupler link 170 while the upper crank 160 rotates about the upper fixed rotational axis 164 defined by the upper axle 190.

The second coupler link 174 has a generally bar-like configuration. At the first end, the second coupler link 174 also comprises a head 202. The lower crank 162 has a boss 204. The head 202 is connected to the boss 204 by a mechanical fastener 206 or the like. Any suitable connection can be used keeping in mind the goal of creating up, down, forward and rearward movement of the first end of the second coupler link 174 while the lower crank 162 rotates about the lower fixed rotational axis 166 defined by the lower axle 192, thereby defining the second pin joint 176.

The first coupler link 170 comprises a tab 210 that can be positioned at an intermediate portion of the illustrated first coupler link 170. In the illustrated arrangement, the first coupler link 170 comprises a bent tubular member. In particular, from the end of the first coupler link 170 that comprises the sleeve 196, the illustrated first coupler link 170 comprises a first bend 212, a second bend 214 and a third bend 216. The tab 210 is positioned proximate the second bend 214.

The second end of the second coupler link 174 preferably is pivotally connected to the tab 210. In the illustrated embodiment, the second coupler link 174 is secured to the tab 210 by a mechanical fastener 220. Any other suitable technique can be used to secure the second coupler link 174 to the first coupler link 170 keeping in mind the goal of providing a pivot connection between the first and second coupler links 170, 174, thereby defining the third pin joint 180.

As illustrated, an upper pulley 184 preferably is secured to the upper axle 190 such that the upper pulley 184 and the upper axle 190 rotate together while a lower pulley 186 is secured to the lower axle 192 such that the lower pulley 186 and the lower axle 192 rotate together. The pulleys 184, 186 and the axles 190, 192 can be secured together in any suitable manner. Preferably, the pulleys 184, 186 have the same effective diameter such that the axles 190, 192 will rotate at the same speed. In some configurations, one or both of the pulleys can have an adjustable effective diameter (e.g., a continuously variable transmission type of pulley) such that the relative rotational speeds or the relative orientations can be adjusted to alter the driven motion. A belt, chain, cord or other flexible transmitter 188 interconnects the two pulleys 184, 186, such that the two pulleys 184, 186 rotate together.

With continued reference to FIG. 10, a secondary pulley 222 is provided on the lower axle 192. The secondary pulley 222 can be provided in other locations; however, mounting the secondary pulley 222 to the lower axle 192 provides a compact configuration. The secondary pulley 222 cooperates with an electronic or mechanical brake 224. The brake 224 comprises a pulley and a flexible transmitter 226 interconnects the secondary pulley 222 with the pulley of the brake 224. The brake 224 can be any suitable component that resists movement of the operating linkage 104. In some configurations, separate brakes can be provided for each side of the exercise machine 100. In other configurations, separate brakes can be provided for the upper axle 190 and the lower axle 192. In yet other configurations, the brake 224 can be replaced by a component (e.g., a motor/generator) that can drive the operating linkage 104 at varying rates of speed.

Figure 12:
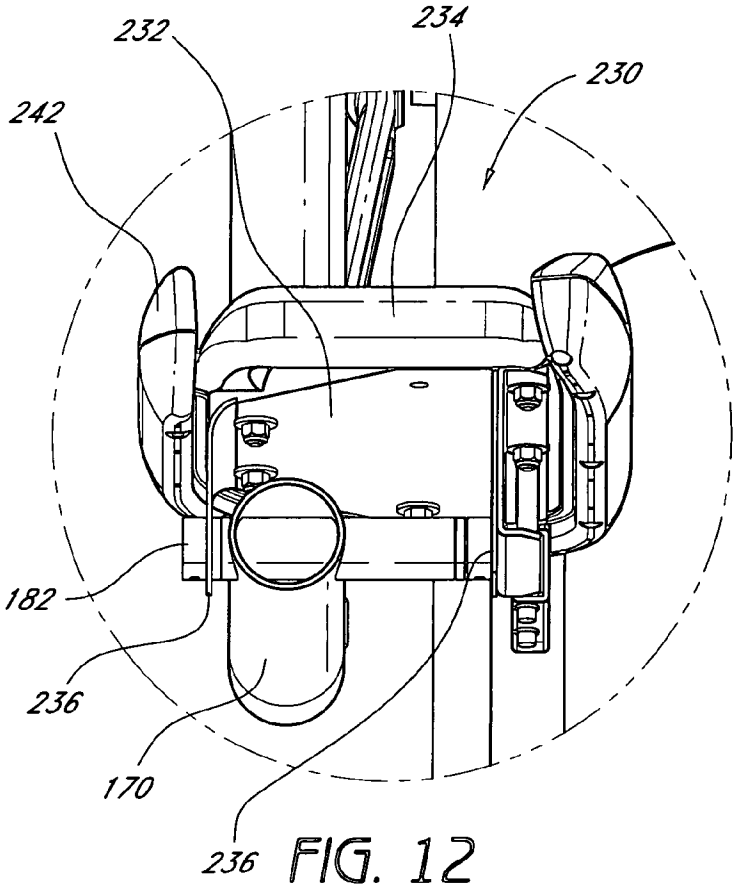
FIG. 12 is an enlarged rear side elevation view taken from the circle 12 in FIG. 5 and showing the foot support of FIG. 11.
Figure 11:
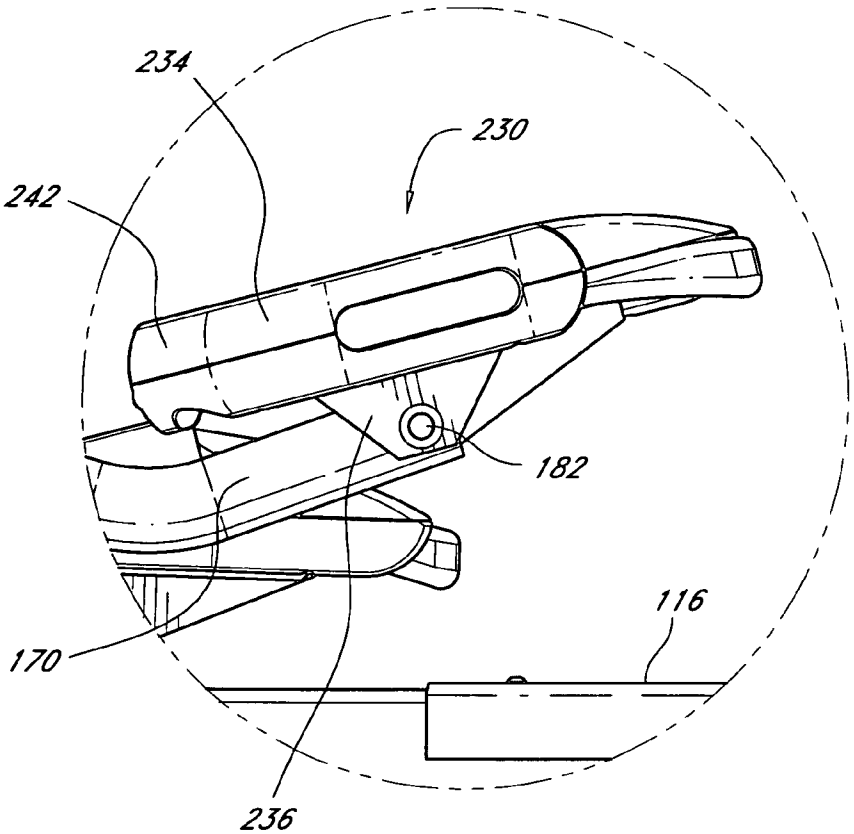
FIG. 11 is an enlarged left side elevation view taken from the circle 11 in FIG. 3 and showing a foot support used with the exercise machine shown in FIG. 1.

A foot support 230 is connected to the second end of each first coupler link 170. Thus, two foot supports 230 are provided, which are connected respectively to the left and right first coupler links 170. Preferably, the foot supports 230 are pivotable relative to the first coupler link 170. With reference to FIGS. 11 and 12, the illustrated foot supports 230 comprise a base plate 232 and a foot pad 234. The illustrated base plate 232 comprises a pair of downwardly depending ears 236. The ears 236 are used to secure the base plate 232 to the second end of the first coupler link 170. In one configuration, a shaft 240 extends through apertures formed in the ears 236 and corresponding apertures formed in the first coupler link 170. Any other suitable configuration can be used to mount the foot supports 230 to the operating linkage 104.

The foot pad 234 can be formed of any suitable material. In one configuration, the foot pad 234 is rubberized to provide cushioning as well as a skid-resistant surface. Moreover, the foot pad 234 preferably comprises an upstanding wall 242. The upstanding wall 242 preferably extends around at least a portion of the foot pad 234. In one preferred configuration, the wall 242 extends around an inner edge, a forward edge and a portion of an outer edge of each foot pad 234.

The exercise machine 100 also comprises adjustable arm linkages 250. Each of the arm linkages 250 connects a pair of handles 252 to the operating linkage 104. Advantageously, the arm linkages 250 enable movement of the handles 252 to be adjusted. In some configurations, the handles 252 can be brought to a stop. In some other configurations, the sweep angle of the handles 252 can be increased or decreased as desired. Preferably, in either configuration, the handles 252 are moveable in a synchronized relationship with the operating linkage 104.

Each of the arm linkages 250 comprises a lower strut 254 that is secured to a suitable region of the operating linkage 104. In the illustrated arrangement, the strut 254 is secured to the foot support 230. Any suitable structure can be used to connect the strut 254 and the operating linkage 104 keeping in mind the desire to create movement of the strut 254 through movement of the operating linkage 104. By connecting the lower strut 254 to the pivotally mounted foot support 230, movement of the foot support 230 can be somewhat controlled by the interrelationship of the arm linkage 250 and the operating linkage 104. In other words, the illustrated arrangement allows pivotal movement of the foot supports 230 relative to the operating linkage 104 to be forced.

As best shown in FIG. 6, the lower strut 254 extends forward of the foot support 230 and through an opening 256 defined in the housing 106. With reference again to FIG. 11, a lower end of a lever 260 is pivotally connected to the forward end of each of the lower struts 254. Any suitable pivotal connection can be used. An upper end of the lever 260 can be pivotally connected to the frame assembly 102 at a pivot point 261. In the illustrated arrangement, the upper end of the lever 260 is pivotally mounted by bearings 262 that are secured to the rearward posts 132 of the frame assembly 102. Thus, the levers 260 can swing forward and rearward with movement of the foot supports 230 and the associated components of the operating linkage 104.

A flange 264 extends forward from an upper portion of the illustrated lever 260. The flange 264 can be integrally formed with the lever 260; however, in the illustrated arrangement, the flange 264 is a separate component that is secured to the lever 260 in any suitable manner. For instance, but without limitation, the flange 264 can be welded to the lever 260, secured to the lever 260 by mechanical interlock, by mechanical fastener or any combination of these techniques.

A first end of a coupler link 266 is pivotally connected to the flange 264. In the illustrated arrangement, the flange 264 comprises a short shaft and the coupler link 266 comprises an aperture through which the shaft extends. A circlip is used to secure the coupler link 266 onto the shaft of the flange 264.

A second end of the coupler link 266 is pivotally connected to a rocker link 270 at a pivot point 271. The rocker link 270 is secured to a sleeve 272. In the illustrated arrangement, the rocker link 270 is welded to the sleeve 272 and the rocker link 270 is pinned to the coupler link 266. Due to the illustrated linkage, movement of the foot supports 230 is conveyed through the linkage to the sleeve 272. Thus, the sleeve 272 pivots about an axis S (i.e., rotation in a first direction followed by counter-rotation in a second direction) as the foot supports 230 move forward and rearward along a path dictated by the operating linkage 104.

As will now be explained, the sleeves 272 have movement that can have a varying angular dimension. In other words, the movement of the sleeves 272 can be increased and decreased such that larger or small arcs are swept by the movement of the sleeves 272. In short, the movement is varied by adjusting the location of the pivot point 271 between the coupler link 266 and the rocker link 270 relative to the location of the pivot point 261 between the lever 260 and the frame assembly 102. When the two pivotal points 261, 271 are aligned, or close to being aligned, the sleeves 272 are stationary or substantially stationary. As the pivot points 261, 271 are increasingly moved out of alignment, the sweep of each of the sleeves 272 increases in range.

Figure 14:
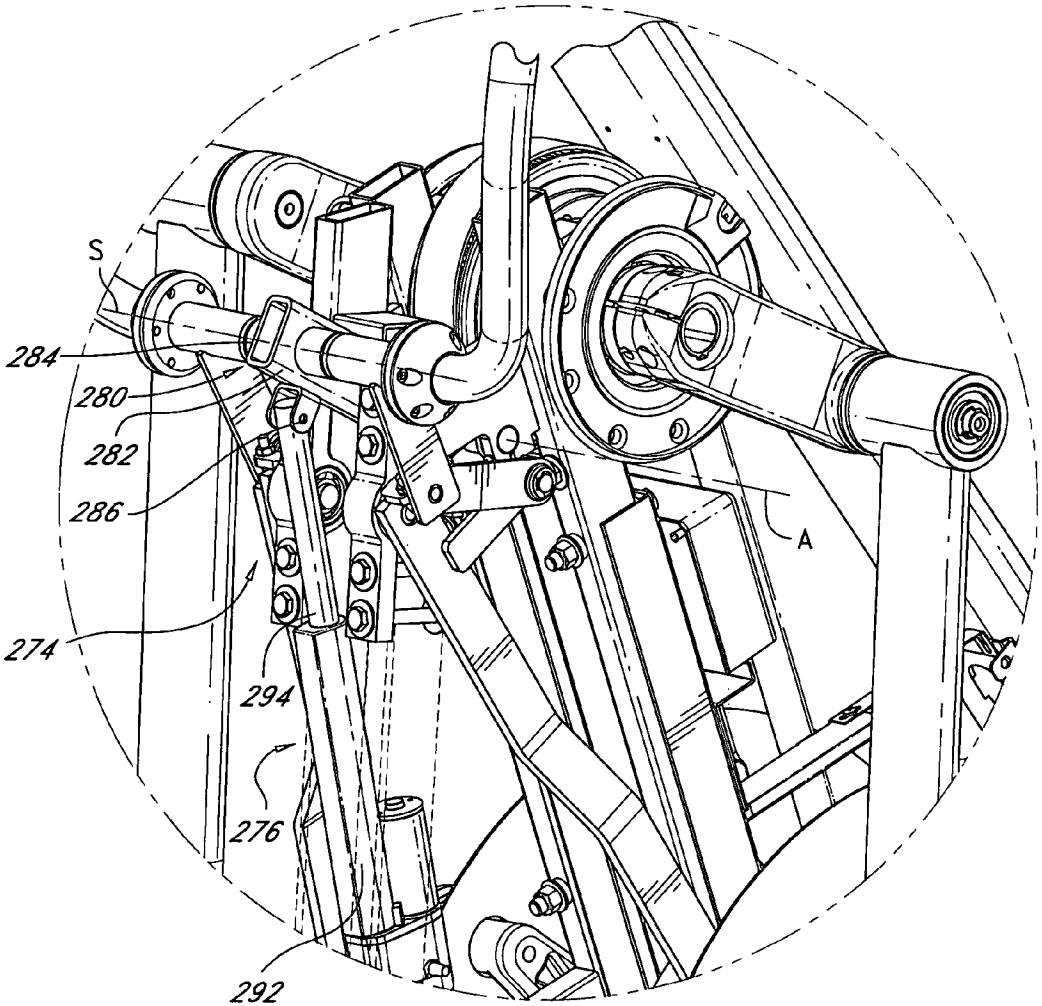
FIG. 14 is an enlarged top right perspective view of the lower portion of the exercise machine taken from the circle 14 in FIG. 13 with some components removed or shown in broken lines for clarity.

In the illustrated arrangement, relative movement of the pivot points 261, 271 is controlled through an adjustment mechanism 274. For clarity, the adjustment mechanism 274 is shown in FIG. 14. As illustrated, the adjustment mechanism 274 comprises an actuator 276 and a tie assembly 280. The tie assembly 280 of the illustrated arrangement guides movement of the pivot axis S. In particular, the illustrated arrangement uses the tie assembly 280 to guide the pivot axis S about a secondary pivot axis A. The movement is controlled with the actuator 276.

The tie assembly 280 can have any suitable configuration keeping in mind the desire to alter the relative position of the pivot points 261, 271. The illustrated tie assembly 280 generally comprises a lever 282 and a support bar 284. The lever 282 is formed of rectangular tube stock in the illustrated arrangement with the support bar 284 extending through a first end of the lever 282. The second end of the lever 282 is pivotally mounted to a bracket that is secured to the frame assembly 102. Thus, the second end of the lever 282 pivots about the axis A.

The sleeves 272 of the arm linkages 250 are mounted on the ends of the support bar 284. In some configurations, the sleeves 272 are mounted on bushings or bearings to allow improved relative movement between the sleeves 272 and the support bar 284. In other configurations, materials are selected for the sleeves 272 and the support bar 284 to provide sufficiently smooth relative movement between the members.

Figure 13:
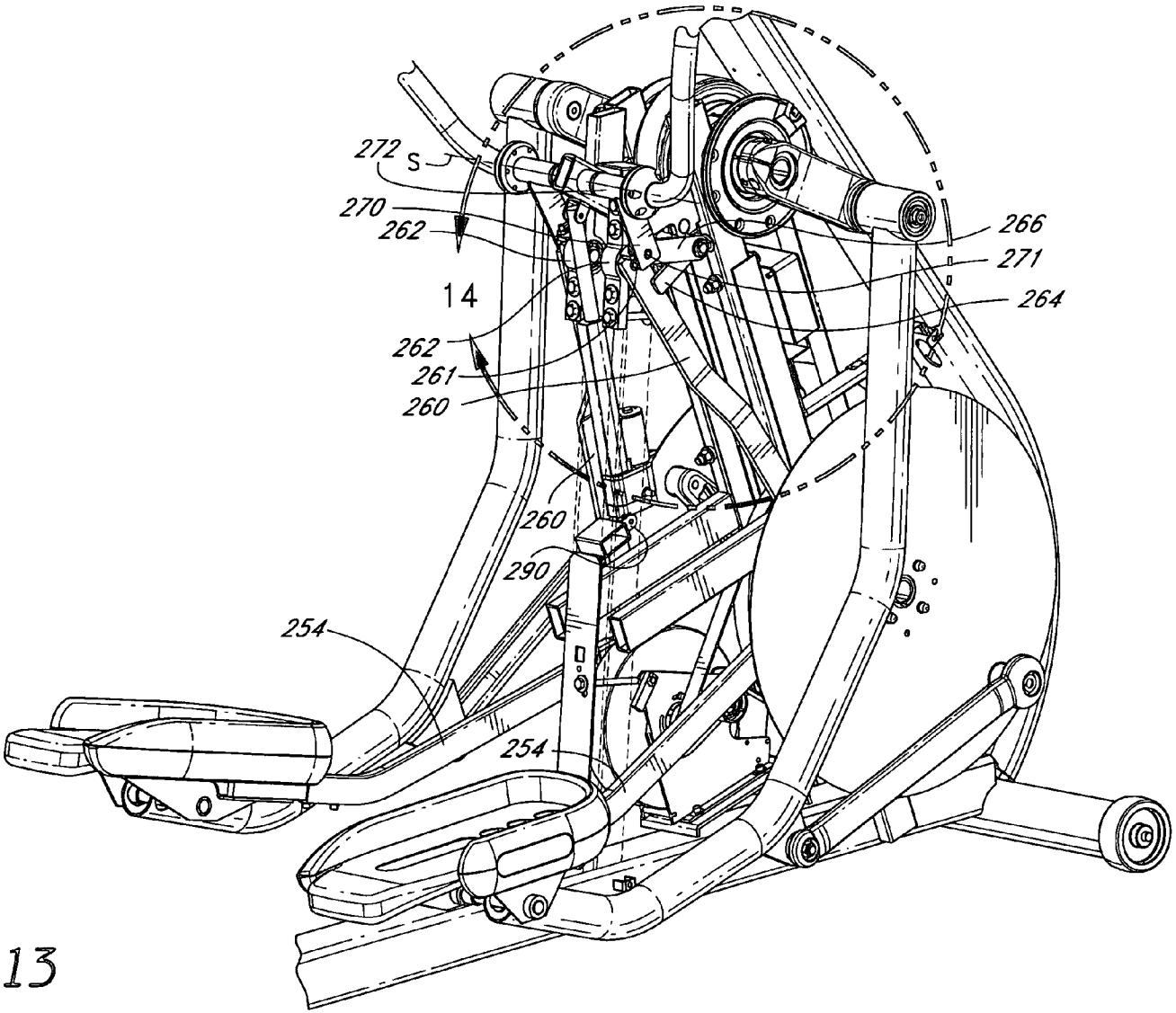
FIG. 13 is a top right perspective view of the lower forward portion of the exercise machine shown in FIG. 1 with some components, including the housing and some of the frame assembly, removed or shown in broken lines for clarity.

An upper bracket 286 is secured to the lever 282. A lower bracket 290 (see FIG. 13) is secured to the frame assembly 102. As described below, the actuator 276 can be any suitable component. In the arrangement shown in FIG. 14, an electromechanical actuator 292 is mounted between the lower bracket 290 and the upper bracket 286. The electromechanical actuator 292 comprises a lead screw 294 that is driven by an electric motor. The lead screw 294 can be used for extension and contraction. As the electromechanical actuator 292 extends, the lever 282 is pivoted upward. As the electromechanical actuator 294 contracts, the lever 282 is pivoted downward. This movement of the lever alters the relationship between the pivot points 261, 271, which alters the sweep of the sleeves 272. Furthermore, the movement of the lever 282 also adjusts the location of the pivot axis S such that it is closer to the user when the sweep angle of the sleeves 272 is the greatest and it is further from the user when the sweep angle of the sleeves 272 is the smallest. While the electromechanical actuator 292 is the actuator 276 in the illustrated configuration, other actuators and mounting configurations also are possible. For instance, hydraulic cylinders, air cylinders, other forms of worm gears, other forms of linear actuators and the like can be used as the actuator and, in some configurations, the pivot axis S can move along a non-arcuate path. Advantageously, the movement of the sleeves 272 about the arcuate path, or any other desired path shape, is accommodated by a suitably shaped opening 295 in the housing 106.

With reference again to FIG. 10, the handles 252 are coupled to the sleeves 272 in any suitable manner. As such, movement of the sleeves 272 generates corresponding movement of the handles 252. In some configurations, movement of the handles 252 can provide an input into the operating linkage 104 rather than being driven as an output of the operating linkage 104. Because the sleeves 272 are driven through a variable sweep angle, the movement of the handles 252 is adjustable among various sweep angles, including, in some configurations, a locked position in which the handles 252 do not move. Two positions are shown in FIG. 15, with one position shown in solid lines and another shown in dashed lines. The positions shown in FIG. 15 represent extremes of movement such that the handles 252 sweep back and forth from the first solid position to the second solid position or from the first dashed position to the second dashed position.

In the illustrated arrangement, collars 296 are secured to hubs 300 that are fixed to the sleeves 272. The collars 296 are secured to the handles 252 in any suitable manner. Thus, the handles 252 are easily replaceable for maintenance purposes. While not illustrated, the handles 252 can comprise heart rate sensors or the like, if desired.

In use, the user stands upon the foot supports 230 and imparts movement to the foot supports 230. The movement of the foot supports 230 results in either forward or rearward movement of the foot supports 230 through a generally elliptical foot trace. As the foot supports 230 are moved, the cranks 160, 162 rotate. Rotation of the cranks 160, 162 is input into the braking device 224. Moreover, the braking device 224 can be used to provide variable-level and/or fixed-level resistance to movement of the foot supports 230, if desired. In some configurations, a motor/generator can be used such that movement of the foot supports 230 can be driven by the machine such that a user moves along with or overdrives the movement provided by the exercise machine.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. An elliptical exercise machine comprising a generally stationary frame assembly, an operating linkage supported by said frame assembly, said frame assembly comprising at least one rearmost upright, said operating linkage connected to a first foot support and a second foot support, said first and second foot supports each adapted to receive a user's foot, said operating linkage comprising a first side and a second side, said first side comprising four moving links connected by three pin joints and said second side comprising four moving links connected by three pin joints, each of said three pin joints on said first side being positioned forward of said first foot support and each of said three pin joints on said second side being positioned forward of said second foot support, each of said first and second foot supports moving through a generally elliptical foot trace during operation of said machine and said foot trace being located rearward of said rearmost upright, each of said first and second foot supports being pivotally mounted to one of said corresponding four moving links at a foot support pivot point that is distinct from said three pin joints.

2. The elliptical exercise machine of claim 1, wherein each set of said four moving links comprises a first crank, a second crank, a first coupler link and a second coupler link, said first and second coupler links being pivotally connected, said first crank and said first coupler link being connected, and said second crank and said second coupler link being connected.

3. The elliptical exercise machine of claim 2, wherein said first foot support is pivotally mounted to said first coupler link of said corresponding four moving links.

4. The elliptical exercise machine of claim 3 further comprising a first handle and a second handle, said first and second handle by movably supported by said frame, a first lever coupled to said first handle and a second lever coupled to said second handle, a first strut connecting said first lever to said first foot support and a second strut connecting said second lever to said second handle.

5. The elliptical exercise machine of claim 4, wherein a first linkage joins a portion of said first lever to said first handle and a second linkage joins a portion of said second lever to said first handle.

6. The elliptical exercise machine of claim 5, wherein said first and second linkages each comprise a coupler link and a rocker link that are pivotally connected, said rocker link being secured to said corresponding handle and said coupler link being joined to said corresponding lever.

7. The elliptical exercise machine of claim 6, wherein a first axis is defined through a pivotal connection between said frame and each of said first and second levers and a second axis is defined through a pivotal connection between said coupler link and said rocker link that is connected to each of said handles, said first axis and said second axis extending in generally the same directions and said second axis being moveable relative to said first axis.

8. The elliptical exercise machine of claim 6, wherein a first axis is defined through a pivot location of said first and second handles, a second axis is defined through a pivotal connection between said coupler link and said rocker link of each handle such that said first axis moves along an arc having said first axis as a center, and a third axis is defined through a pivotal connection between said frame and each of said first and second levers such that as said first axis moves relative to said third axis, a length of said arc is varied.

9. An elliptical exercise machine comprising a generally stationary frame assembly, a first crank rotationally coupled to said frame assembly, said first crank having a second end rotatable about a first rotational axis that extends through a first end of said first crank, the second end of the first crank being rotatable a full circle around said first rotational axis, said second end of said first crank rotationally connected to a first end of a first coupler link, a second crank rotationally coupled to said frame assembly, said second crank having a second end rotatable about a second rotational axis that extends through a first end of said second crank, the second end of the second crank being rotatable a full circle around said second rotational axis, said second end of said second crank rotationally connected to a first end of a second coupler link, a second end of said second coupler link being connected to said first coupler link, a foot support being supported by said first coupler link and said first and second cranks being synchronized together.

10. An elliptical exercise machine comprising a generally stationary frame assembly, an operating linkage supported by said frame assembly, said operating linkage comprising a left subassembly and a right subassembly, said left subassembly comprising a first geared five bar mechanism and said right subassembly comprising a second geared five bar mechanism, said first geared five bar mechanism comprising a first crank rotatable about a first pin joint, a first coupler link connected to said first crank at a second pin joint, a second coupler link connected to said first coupler link at a third pin joint, a second crank connected to said second coupler link at a fourth pin joint and said second crank being rotatable about a fifth pin joint, and a first foot support supported by said first coupler link at a position generally rearward of said third pin joint.

11. The elliptical exercise machine of claim 10, wherein said first foot support is pivotally mounted to said first coupler link.

* * * * *

UNITED STATES PATENT AND TRADEMARK OFFICE

CERTIFICATE OF CORRECTION

PATENT NO. : 7,670,266 B2
APPLICATION NO. : 11/192977
DATED : March 2, 2010
INVENTOR(S) : Cornejo et al.

It is certified that error appears in the above-identified patent and that said Letters Patent is hereby corrected as shown below:

Title page, (Item 73), Assignee: change "Unisen, Inc.," to --Unisen, Inc., dba Star Trac--.

Signed and Sealed this

Fourteenth Day of September, 2010

David J. Kappos

David J. Kappos
*Director of the United States Patent and Trademark Office*